US011221139B2

(12) United States Patent
Tabaries et al.

(10) Patent No.: US 11,221,139 B2
(45) Date of Patent: Jan. 11, 2022

(54) BOILER CLEANING PROCESS, CORRESPONDING DEVICE AND BOILER

(71) Applicant: CONSTRUCTIONS INDUSTRIELLES DE LA MÉDITERRANÉE—CNIM, Paris (FR)

(72) Inventors: Frank Tabaries, Saint Mandrier sur Mer (FR); Yann Laborel, Cassis (FR); Thomas Feilenreiter, Paris (FR)

(73) Assignee: CNIM ENVIRONNEMENT & ENERGIE SERVICES, Paris (FR)

( * ) Notice: Subject to any disclaimer, the term of this patent is extended or adjusted under 35 U.S.C. 154(b) by 347 days.

(21) Appl. No.: 16/313,385

(22) PCT Filed: Jun. 30, 2017

(86) PCT No.: PCT/EP2017/066266

§ 371 (c)(1),
(2) Date: Dec. 26, 2018

(87) PCT Pub. No.: WO2018/002299

PCT Pub. Date: Jan. 4, 2018

(65) Prior Publication Data

US 2019/0154256 A1 May 23, 2019

(51) Int. Cl.

| | |
|---|---|
| ***F23J 15/00*** | (2006.01) |
| ***F23J 3/02*** | (2006.01) |
| ***F23J 7/00*** | (2006.01) |

(52) U.S. Cl.

CPC ..... *F23J 15/003* (2013.01); *F23J 3/023* (2013.01); *F23J 7/00* (2013.01)

(58) Field of Classification Search

CPC ..... F23J 7/00; F23J 3/023; F23J 15/003
See application file for complete search history.

(56) References Cited

U.S. PATENT DOCUMENTS 5,058,514 A * 10/1991 Mozes ..... F23J 7/00 110/345
5,342,592 A * 8/1994 Peter-Hoblyn ..... B01D 53/60 423/235

(Continued)

FOREIGN PATENT DOCUMENTS

DE 3318374 A1 11/1984
DE 4424090 A1 1/1996

(Continued)

OTHER PUBLICATIONS

International Search Report and Written Opinion, dated Aug. 30, 2017, from corresponding PCT application No. PCT/EP2017/066266.

*Primary Examiner* — Steven S Anderson, II
(74) *Attorney, Agent, or Firm* — Nixon & Vanderhye

(57) ABSTRACT

Disclosed is a process for cleaning a boiler, wherein, while fumes are emitted in a combustion chamber of the boiler and circulate up to exchangers of the boiler, an aqueous solution of dissolved magnesium chloride and/or sulfate and/or dissolved calcium chloride is injected into the combustion chamber in the form of droplets which, by vaporization of the water of the aqueous solution, then thermal decomposition, are transformed in the combustion chamber into magnesium and/or calcium oxide particles reacting in the combustion chamber by mixing with molten salts and/or molten oxides, present in the fumes, to crystallize these molten salts and/or to vitrify these molten oxides before these molten salts and/or these molten oxides come into contact with the exchangers. Also disclosed is a device for implementing this process and a boiler equipped with this device.

15 Claims, 1 Drawing Sheet

(56) References Cited

U.S. PATENT DOCUMENTS

| | | | | | |
|---|---|---|---|---|---|
| 5,468,460 | A * | 11/1995 | Lin | B01D 53/502 | 252/182.32 |
| 5,937,772 | A * | 8/1999 | Khinkis | F23G 5/002 | 110/345 |
| 6,213,032 | B1 * | 4/2001 | Breen | B01D 53/56 | 110/203 |
| 6,471,506 | B1 * | 10/2002 | Zamansky | B01D 53/56 | 431/10 |
| 7,524,472 | B1 * | 4/2009 | Kong | B01D 53/64 | 252/181.1 |
| 8,052,803 | B2 | 11/2011 | Aho | | |
| 9,303,870 | B2 | 4/2016 | Abeyta | | |
| 2004/0018133 | A1 * | 1/2004 | Radway | B01D 53/50 | 423/244.05 |
| 2008/0110381 | A1 * | 5/2008 | Swanson | B01D 53/79 | 110/345 |
| 2012/0090517 | A1 * | 4/2012 | Radway | B01D 53/505 | 110/342 |
| 2012/0247405 | A1 * | 10/2012 | Abeyta | F22B 37/54 | 122/390 |
| 2018/0093220 | A1 * | 4/2018 | Shimohira | B01D 53/185 | |

FOREIGN PATENT DOCUMENTS

| | | | | |
|---|---|---|---|---|
| DE | 4446913 | A1 | 7/1996 | |
| DE | 19849022 | A1 * | 4/2000 | F23G 5/48 |
| DE | 19849022 | A1 | 4/2000 | |
| EP | 2578936 | A1 * | 4/2013 | F23J 7/00 |
| RU | 2285218 | C1 | 10/2006 | |
| RU | 2393205 | C2 | 6/2010 | |
| SU | 1440531 | A1 | 11/1988 | |
| TW | 201509511 | A | 3/2015 | |

* cited by examiner

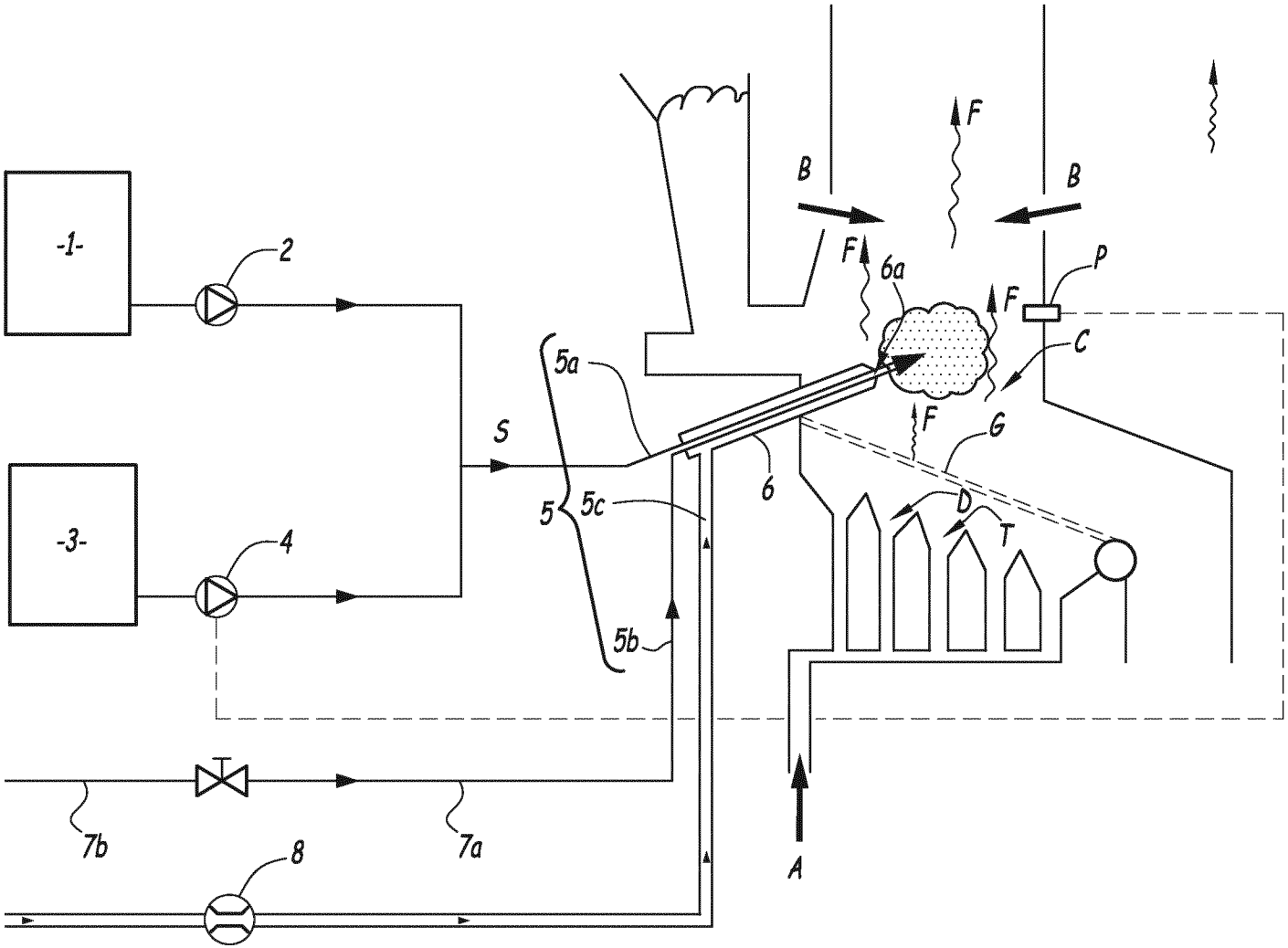
B
P
C
F
G
T
D
6a
6
A
5a
5c
5b
5
S
7a
7b
2
4
8
-1-
-3-

BOILER CLEANING PROCESS, CORRESPONDING DEVICE AND BOILER

BACKGROUND OF THE INVENTION

Field of the Invention

The present invention relates to a boiler cleaning process, and a device for carrying out this process. The present invention also relates to boilers equipped with such a device.

Description of the Related Art

Boilers, and in particular those installed downstream from combustion devices that combust fuels in particular containing a mineral fraction, become dirty over time, resulting in decreased efficiency and performance. The dirtying of the boilers in particular corresponds to the deposition, on the surface of their exchangers, of layers of oxide mixtures and salt mixtures of various natures. In general, the fumes in the boilers comprise carbon dioxide ($CO_2$), oxygen ($O_2$), nitrogen ($N_2$), steam and solids suspended in the gases, the solids being made up of mixtures of molten oxides (calcium, sodium and potassium aluminosilicates) and molten salt mixtures (alkali, alkali earth and heavy metal chlorides and sulfates, for example NaCl, KCl, $ZnCl_2$, $PbCl_2$, etc.). These oxide mixtures and salt mixtures have melting temperatures lower than the adiabatic temperature of the gases in the combustion chamber: they are therefore in the form of liquid drops in the combustion chamber. When they impact the exchangers, which are colder than the gases, the oxide mixtures will vitrify on the surface of these exchangers and the pasty molten salt mixtures will adhere to the surface of the exchangers and, depending on the surface temperature of these exchangers, they will remain in the liquid phase or will crystallize. In addition to these deposits, which alter the overall exchange coefficient and therefore reduce the overall efficiency and performance of the boiler, the molten salts not crystallized create an electrolyte responsible for corrosion phenomena that may go as far as piercing the tubes of the exchanger and stopping the boiler, thereby decreasing the availability of the facility and the lifetime of the affected exchangers.

It is consequently necessary, to maintain the expected performance levels, to clean the boilers, and in particular the surfaces of their exchangers. In order to decrease the loss of availability following a stoppage of the facility for cleaning, it is interesting to be able to propose cleaning methods that can be carried out during the operation of the boiler (when the boiler is said to be running) without it being necessary to stop the facility or reduce its load.

Processes for cleaning running boilers already exist. For example, sweeping operations with steam or compressed air can be carried out, striking methods generating a shockwave "detaching" the deposits from the surface of the exchangers, shot peening techniques corresponding to a gravitational flow of steel beads eroding the oxide layer formed on the surface of the exchangers, methods using the injection of powdered solids in the combustion chamber, techniques using the explosion of gas pockets. However, irrespective of the process used, it is still necessary to stop the facility 1 to 3 times throughout the year to perform a cleaning operation, in particular semi-manual, the duration of which (generally 3 to 5 days) depends on the significance of the dirtying of the boiler. These cleaning operations are costly and generate facility downtime, the cost of which is extremely high, in particular when they occur during the maximum energy sales season. There is additionally a risk of mechanical stressing and leakage of the exchangers upon each restart, requiring a new immobilization of the facilities for repairs. Furthermore, the aforementioned current techniques suffer from certain drawbacks: the mechanical cleaning devices (shot peening, striking), due to the mechanical stresses induced, reduce, sometimes considerably, the lifetime of the surfaces of the exchangers (erosion by the steel beads, stress phenomena related to the shockwaves from the striking, etc.); the use of explosion techniques is effective, but very costly, and entails a non-negligible risk for operators during handling of the explosive gases; using steam causes mechanical wear problems and decreases the net steam production performance; furthermore, increasing the steam in the fumes affects the acid dew point, which may lead to corrosion phenomena in the cold parts of the boiler; the use of products in powdered form also has drawbacks, since the product, the grains of which have a diameter generally greater than 10 μm (close to the mean size of the particles that make up the ash), have a physical, and not chemical, action inasmuch as, the contact surface being small, the chemical reactions between solids are not significant, or are even practically nonexistent.

US 2012/247405 illustrates one of the existing cleaning techniques listed above, i.e., the introduction of powdered solid compounds into a boiler to be cleaned.

In turn, DE4446913 discloses a process for reducing the emission of pollutants by solid fuel boilers. According to this process, a reducing agent, which reduces the NOx (nitrogen oxides) and which is in particular made up of urea or an ammonia solution, is introduced into the combustion chamber of a boiler, jointly with the introduction of an aqueous solution of salts chosen from among alkali metals, alkali earth metals, iron, and rare earth metals. As explained in this document, the salts of this aqueous solution are provided to catalyze the NOx reduction reaction by the aforementioned reducing agent. In other words, these salts are catalysts for the NOx reduction. In essence, such catalysts are not consumed, but modify the reaction kinetics: the aforementioned salts favor the oxidation of partially oxidized compounds, such as carbon monoxide, and non-oxidized compounds, such as organic compounds (dioxin, HAP, etc.) and combustion residues in the ash. These oxidation reactions accelerated by the catalyst salts being exothermic, they tend to increase the combustion temperature, which supports the temperature decrease due to the introduction of the reducing agent. DE4446913 therefore does not disclose how to act directly on the molten salts and the molten oxides, which are present in the fumes emitted by the combustion in the boiler and which, as explained above, are responsible for the dirtying of the exchangers of the boiler. More generally, DE4446913 does not teach how to clean a boiler, since the implementation of its process makes it possible, in addition to limiting NOx emissions, to simply limit the share of combustion residues in the material resulting from the combustion due to the fact that the oxidation of the partially burned or unburned compounds is catalyzed.

DE4424090 also discloses a combustion catalysis process, which is analyzed in exactly the same manner as above for the process of DE4446913.

DE3318374 discloses a process for desulfurizing combustion fumes, which is based on the presence of earth alkali metal and/or alkali metal oxide particles at the time of the combustion: these oxide particles will react with the sulfur oxides present in the fumes, to form sulfates and sulfites. These oxide particles have a diameter of several tens of μm and are introduced into the combustion chamber in the form of a stable suspension of these oxide particles or a colloidal solution of these oxide particles. In light of the large size of these oxide particles, and inasmuch as they are consumed by reacting with the sulfur oxides, these oxide particles cannot act on the molten salts and the molten oxides, which are present in the fumes and which, as explained above, are responsible for the dirtying of the exchangers of the boilers. More generally, the process of DE3318374 does not ensure cleaning of the boilers, except perhaps in the scenario where part of the aforementioned "large" oxide particles is not consumed by reacting with the sulfur oxides and then acts physically, i.e., mechanically, on the surface of the exchangers, in exactly in the same way as the cleaning techniques using powders or other powdered solids, as previously mentioned.

There is consequently an interest in supplying a new process for cleaning running boilers, making it possible to resolve all or some of the drawbacks of the methods traditionally used.

SUMMARY OF THE INVENTION

One aim of the present invention is to propose a new process for cleaning running boilers that can be implemented on any type of boiler.

Another aim of the present invention is to propose such a process in particular making it possible to considerably reduce the number of annual stoppages for cleaning of the boiler, as well as their duration.

Still another aim of the present invention is to propose such a process enabling physicochemical cleaning of the surfaces of the exchangers.

Another aim of the present invention is to propose such a process making it possible to limit the corrosion phenomena by the molten salts deposited on the surface of the heat exchangers.

One aim of the present invention is also to propose a device for carrying out such a process.

Still other aims will appear upon reading the following description of the invention.

To respond to the aforementioned aims and resolve the problems of the prior art, the present invention proposes a process for cleaning a boiler, wherein, while fumes are emitted in a combustion chamber of the boiler and circulate up to exchangers of the boiler, an aqueous solution of dissolved magnesium chloride and/or sulfate and/or dissolved calcium chloride is injected into the combustion chamber in the form of droplets which, by vaporization of the water of the aqueous solution, then thermal decomposition, are transformed in the combustion chamber into magnesium and/or calcium oxide particles reacting in the combustion chamber by mixing with molten salts and/or molten oxides, present in the fumes, to crystallize these molten salts and/or to vitrify these molten oxides before these molten salts and/or these molten oxides come into contact with the exchangers.

The process according to the invention can be carried out for any type of boilers, and more particularly for heat recovery boilers installed downstream of combustion devices. More particularly, the fuels can by any type of fuels comprising a mineral fraction, for example: household or industrial waste, hazardous waste, charcoal, wood, biomass, etc.

The process according to the invention advantageously allows cleaning of the entire boiler from its combustion chamber to a filter downstream from its exchangers.

The magnesium chloride and/or sulfate and/or the calcium chloride that are used in the process according to the invention have the advantage of being soluble in water in large proportions in order to allow their injection without large quantities of water being necessary. The solution containing them is thus an aqueous solution of dissolved salts, and not a dispersion of solids in water. As specified later, this then allows the injection into the boiler to create droplets of dissolved magnesium chloride and/or sulfate and/or droplets of dissolved calcium chloride, then to produce, by decomposition/thermal hydrolysis, mixtures of magnesium and/or calcium oxides in the form of particles with a very small diameter (much smaller than 10 μm, around a μm) and therefore having a very large specific surface area compared to the existing cleaning powders frequently used, which generally have a particle size much larger than 10 μm, typically from 10 to 50 μm.

The magnesium and/or calcium oxide particles react by mixing with the molten salts and/or the molten oxides, present in the fumes of the combustion chamber of the boiler, which makes it possible, as explained in detail later, to significantly increase the melting temperature of the resulting mixtures. Irrespective of the physicochemical mechanisms that are actually implemented by the invention and that are mentioned in more detail later, the inventors have observed a remarkable effect on the dirtying of the boiler. Indeed, the inventors have compared a same boiler under identical operating conditions, with the sole difference that in a first case, the process according to the invention is implemented, whereas in the second case, this process is not used: in both cases, the inventors monitored the evolution over time of the temperature of the fumes leaving the boiler, as well as the evolution of the exhaust fan of the boiler. It was revealed that, unlike the second case, the first case shows a decrease of the temperature over time, which proves that the overall exchange coefficient improves over time in the first case while the coefficient deteriorates in the second case, on the one hand, and a decrease over time in the speed of the exhaust fan, whereas the speed increases in the second case, on the other hand: the deterioration of the overall exchange coefficient and the increase of the pressure loss, responsible for the increased speed of the exhaust fan, reflect increased dirtying of the boiler in the second case compared to the first case implementing the invention. The invention thus indeed makes it possible to control and limit the dirtying of the boilers.

The invention also relates to a device for cleaning a boiler, the device implementing the process as defined above and comprising:

- a source of an aqueous solution of dissolved magnesium chloride and/or sulfate and/or dissolved calcium chloride,
- an injection system for injecting the aqueous solution inside the combustion chamber of a boiler to be cleaned, and
- a supply circuit for supplying the injection system, suitable for both transporting the aqueous solution from the source to the injection system and cooling the injection system.

This device makes it possible to carry out the process according to the invention.

The invention also relates to a boiler, equipped with a cleaning device as defined above, and wherein the injection system of the cleaning device is situated in the lower part of a furnace of the combustion chamber, where a primary combustion develops.

According to optional advantageous features of the process, the device and the boiler according to the invention:

- The aqueous solution is injected into a lower part of a furnace of the combustion chamber, where a primary combustion develops.
- The lower part of the furnace of the combustion chamber has a temperature of at least 1100° C.
- The aqueous solution is injected into the combustion chamber between a grate of this combustion chamber and secondary air injections.
- The aqueous solution is injected into the combustion chamber such that the magnesium and/or calcium oxide particles that the aqueous solution produces therein have a mean diameter smaller than 10 μm, preferably comprised between 0.1 and 5 μm.
- The aqueous solution is a solution of:
  - $MgSO_4$; or
  - $MgCl_2$; or
  - $MgSO_4$ and $MgCl_2$; or
  - $CaCl_2$; or
  - $MgCl_2$ and $CaCl_2$.
- The aqueous solution comprises from 6 to 600 g/l of dissolved anhydrous magnesium chloride and sulfate and calcium chloride.
- Between 10 l and 100 l of the aqueous solution is injected into the combustion chamber per ton of waste incinerated in the boiler, or
- between 2 l and 20 l of the aqueous solution is injected into the combustion chamber for 1000 $Nm^3$ of gases produced by the combustion in the boiler when the fuels of the boiler are not waste.
- The aqueous solution is injected into the combustion chamber using a compressed air spraying device or a high-pressure pump.
- At least one additional cleaning technique is implemented, chosen from among:
  - micro-explosion;
  - steam injection; and
  - striking.
- The supply circuit comprises a cooling line to cool the injection system, suitable for sending the injection system a cooling fluid, the cooling line preferably being supplied by a blocking air fan.
- The source comprises:
  - a first vat in which a solution concentrated in magnesium chloride and/or sulfate and/or calcium chloride is stored,
  - a first metering pump suitable for metering the concentrated solution of the first vat and bringing this concentrated solution from the first vat to the supply circuit,
  - a second vat in which water is stored, and
  - a second metering pump suitable for metering the water of the second vat and bringing this water from the second vat to the supply circuit, where this water mixes with the concentrated solution brought in by the first metering pump to form the aqueous solution.
- The injection system comprises at least one compressed air spraying device, and wherein the supply circuit comprises:
  - a liquid transport line, which transports the aqueous solution from the source to the at least one compressed air spraying device and the liquid pressure of which is preferably comprised between 1 and 6 bars, and
  - an air supply line, which supplies compressed air to the at least one compressed spraying device to assist with spraying and the air pressure of which is preferably comprised between 1 and 6 bars.

BRIEF DESCRIPTION OF THE DRAWINGS

The invention will be better understood upon reading the following description, provided solely as an example and partially done in reference to a FIGURE, which is a diagram of a boiler equipped with a cleaning device carrying out the inventive process.

DESCRIPTION OF THE PREFERRED EMBODIMENTS

FIG. 1 shows a boiler equipped with a cleaning device that will be outlined later. The boiler has a combustion chamber C where fumes F resulting from the combustion of fuels are emitted. In the example of FIG. 1, the combustion, in particular of waste or biomass, is done on a grate G installed in the combustion chamber C, primary air A for the primary combustion of the fuels being injected below the grate, if applicable in a staged manner via distribution boxes including a second primary air injection box, referenced D in FIG. 1, and a third primary air injection box, referenced T in FIG. 1. Secondary air B can be injected in the combustion chamber C, in a zone of the latter which, in the example of FIG. 1, is situated above the grate G, the secondary air B being supplied through walls of the combustion chamber: the fumes F, which are produced in a so-called lower part of the furnace of the combustion chamber C, where the primary combustion develops and which, in the example of FIG. 1, is situated between the grate G and the secondary air injections B, are then, immediately downstream of this lower part of the furnace, mixed with the secondary air B to allow a complete post-combustion. In a manner not illustrated in FIG. 1, tertiary air may also be injected into the fumes, downstream from the injections of secondary air B. In all cases, the fumes F thus circulate from the combustion chamber C to exchangers of the boiler, not illustrated in FIG. 1, at which the heat from the fumes is partially recovered.

According to the invention, an aqueous solution S containing dissolved magnesium chlorides and/or sulfates and/or dissolved calcium chlorides is injected into the combustion chamber C in order to clean the boiler. Preferably, these chlorides and/or sulfates are chosen from among $MgSO_4$, $MgCl_2$ or $CaCl_2$, alone or in a mixture. In particular, the aqueous solution S is chosen from among the following aqueous solutions:

- $MgSO_4$; or
- $MgCl_2$; or
- $MgSO_4$ and $MgCl_2$; or
- $CaCl_2$; or
- $MgCl_2$ and $CaCl_2$.

Preferably, the aqueous solution S is a solution of dissolved $MgSO_4$.

The aqueous solution S advantageously has a concentration of magnesium and calcium, anhydrous, chloride and sulfate comprised between 6 and 600 g/l, preferably between 6 and 60 g/l.

The process according to the invention can be qualified as physicochemical inasmuch as, after vaporization of the water of the aqueous solution S injected into the combustion chamber, then thermal decomposition of the dissolved salts that it contains, i.e., the magnesium and/or calcium chlorides and/or magnesium sulfates, these salts are transformed, in whole or in part, into small magnesium and/or calcium oxide particles, namely having a mean diameter smaller than 10 μm, preferably comprised between 0.1 and 5 μm, and behaving like refractory compounds with respect to molten oxide mixtures and molten salt mixtures, present in the fumes, thereby significantly increasing their melting temperature. Secondly, these crystallized magnesium and/or calcium oxide particles aggregate on the surface of the still-melting parts of the drops of molten salt mixtures and drops of molten oxide mixtures, present in the combustion fumes F, and solubilize in these molten salt and oxide mixtures, which causes the crystallization of the molten salt mixtures and vitrification of the oxide mixtures by significantly increasing the melting temperatures of the new mixtures resulting from this solubilization. In parallel to this phenomenon, the vaporization of the water in the injected aqueous solution creates a temper of the combustion fumes F in the injections zone, which will amplify the surface solidification phenomenon of the drops of the molten salt and oxide mixtures present in these combustion fumes, this solidification corresponding to a crystallization of the salt mixtures and a vitrification of the oxide mixtures. These reactions between the magnesium and/or calcium oxide particles and the molten oxide salts present in the fumes occur in the combustion chamber, more particularly in the lower part of the furnace of the combustion chamber, such that the drops, which are initially made up of a mixture of molten salts and/or molten oxides and that react by mixing with the aforementioned magnesium and/or calcium oxide particles, are completely crystallized and/or vitrified on the surface when they come into contact with the surfaces of the exchangers of the boiler, which makes it possible to limit, or even eliminate their adherence and their clumping and corrosive nature.

It should be clearly understood that the magnesium oxide (primarily MgO) and/or calcium oxide (primarily CaO) particles, produced in the combustion chamber C by the injection of the aqueous solution S, adsorb to the surface of the molten oxide and molten salt drops, present in the fumes F, to dissolve therein and modify the surface composition of these drops, thus causing an increase in the melting point of the obtained mixtures relative to the composition of the drops before mixing thereof with the magnesium and/or calcium oxides. There is therefore both a chemical and physical reaction, which can be illustrated by a movement in the phase diagram of the mixture making up the drops present in the fumes: before mixing of the drops with the solid magnesium and/or calcium oxide particles, the composition of these drops makes the latter liquid; whereas by dissolution of the solid magnesium and calcium oxides on the surface of the drops, the surface composition of the latter is enriched with magnesium and/or calcium oxide and moves in the zone of the solid of the phase diagram. It will be understood in passing that the magnesium and/or calcium oxide particles produced by the injection of the aqueous solution S do not serve as catalysts, for example for the oxidation of compounds partially or not burned in the fumes.

Furthermore, the increased melting temperature caused by the dissolution of the magnesium and/or calcium oxides on the surface of the molten oxide and molten salt drops is coupled with a reduction in the temperature of the fumes at the injection of the aqueous solution S due to the aforementioned temper of the fumes: this coupling favors the crystallization of the surface of the molten salt drops and the vitrification of the molten oxide drops. In the phase diagram of the mixture making up the drops present in the fumes, the movement of the composition of the drops in the solid zone of this diagram is thus accentuated.

Advantageously and preferably, in the context of the present invention, the injection of the aqueous solution S is done at the lowest point of the combustion chamber in order to guarantee a long residence time before the drops, in which the magnesium and/or calcium oxide particles react with the mixtures of molten oxides and/or salts, does not impact the first surfaces of the exchangers: the injection of the aqueous solution S is thus preferably done in the aforementioned lower part of the furnace of the combustion chamber C, where the primary combustion develops, before the secondary B and tertiary air injection zones. Ideally, the injection of the aqueous solution S is done in the middle of the primary combustion zone, where the adiabatic temperatures are highest: preferably, the temperature of this zone where the solution S is injected is above 1100° C. This makes it possible for the oxide drops present in the fumes to be liquid in large part, or even in whole, and for the viscosity of the liquid of these drops to be low enough to allow the magnesium and/or calcium oxide particles to penetrate the liquid by diffusion. This also advantageously makes it possible to impact the temperature of the combustion fumes F locally and significantly. The aforementioned injection zone also being the nitrogen oxide formation zone, this will allow a significant decrease in the local temperature (of about 40 to 120° C.) that will act on the production kinetics of the nitrogen oxides and slow their formation speed. For example, for a combustion, in particular of waste or biomass, done on a grate like the grate G of FIG. 1, the solution S is preferably injected at the second D and third T primary air injection boxes. Furthermore, by performing the injection of the solution S between the grate G and the secondary air injections B, this advantageously makes it possible to benefit from a maximum residence time of the solution and mixing and tempering conditions related to the injection of the secondary air B.

The size (mean diameter) of the droplets of solution resulting from the injection of the aqueous solution S and, consequently, the size (mean diameter) of the magnesium and/or calcium oxide particles produced by the vaporization of the water, then the thermal decomposition of the crystallized magnesium and/or calcium chlorides and/or sulfates, may be important. Indeed, it is advantageous for this size (mean diameter) preferably to be lower than 10 μm in order to favor a large specific surface area and to obtain quantitative reactions with the drops made up of mixtures of molten oxides and salts in suspension in the combustion fumes. This size (mean diameter) of the magnesium and/or calcium oxide particles can even preferably be comprised between 0.1 and 5 μm, all of the particles having their individual diameter smaller than 10 μm. It will be noted that the "mean diameter" mentioned here corresponds to the diameter (i.e., the Sauter diameter, also called "the dimension d32", of the particles, for example measured using an ad hoc optical method) below which 50 wt % of the particles are found and therefore above which 50 wt % of the particles are found. This "mean diameter", also called "median diameter" or "Sauter mean diameter", is often denoted d50 in the literature in the field.

The pressure at which the solution S is injected in particular makes it possible to monitor this droplet size. Thus, the injection of the solution S can be done:

using a spraying device assisted by compressed air, in which case the liquid pressure is preferably comprised between 1 and 6 bars and the air pressure is preferably comprised between 1 and 6 bars; or using a high-pressure pump (without the assistance of compressed air), in which case the liquid pressure is preferably comprised between 10 and 50 bars.

Preferably, the injection of the solution S is done by a compressed air spraying device, which consumes less energy.

The solution S can be obtained by dilution, prior to the implementation of the process, of an aqueous solution concentrated in dissolved salts, i.e., magnesium chloride and sulfate and calcium chloride. This concentrated solution being able to go up to the solubility limit of the salts at the storage temperature of the solution before use may comprise from 60 to 600 g/l of dissolved salts. This in particular makes it possible to facilitate the transport of the solution by decreasing the transported volumes. The concentrated solution can be diluted with water before use, this water for example being able to be recycled water coming from the installation to which the boiler belongs. This advantageously makes it possible to limit the liquid waste at the facility, since it is reused in the process. In practice, the quantity of dilution water can be comprised between 5 l and 100 l, for example 25 l±10 l, per liter of the aforementioned concentrated solution. Beyond 100 l of dilution water per liter of concentrated solution, the loss of steam production may be detrimental. As a non-limiting example, the concentrated solution may contain up to 250 g of dissolved anhydrous $MgSO_4$ per liter of concentrated solution.

The injection of dilution water may be made subject to a temperature measurement of the gases in the primary combustion zone of the combustion chamber C. This makes it possible to keep a quasi-constant temperature, which advantageously makes it possible to reduce the production of nitrogen oxide (NOx) and carbon monoxide (CO). This temperature may in particular be measured using an infrared pyrometer and/or a thermocouple. Thus, the quantity of water used in the process according to the invention may be constant or may vary, in particular to have a constant or quasi-constant temperature in the primary combustion zone, comprised between 1000 and 1400° C. depending on the type of boiler and combustion device.

Preferably, in the context of the present invention and for a boiler handling between 3 and 15 tons of household waste per hour, which corresponds to between 20,000 and 75,000 $Nm^3$/h of fumes measured at the boiler outlet, i.e., downstream from the secondary and tertiary air injections, the injection flow rate of the solution S is adjusted so that the quantity of magnesium and calcium chlorides and sulfates, introduced into the boiler by injection of the solution S, represents a quantity comprised between 1 and 10 kg/h. The injection flow rate of the aqueous solution S can be comprised between 100 and 1,000 l/h depending on the size of the combustion facility. In the case where the solution S is obtained by dilution of the concentrated solution C, the injection flow rate of this concentrated solution can be comprised between 5 and 10 l/h.

If we reason in terms of ratio between the quantity of aqueous solution S (in particular, after dilution of the concentrated solution) and the fuels burned in the boiler, it may be provided that:

between 10 l and 100 l of the aqueous solution S is injected per ton of waste incinerated in the boiler, or between 2 l and 20 l of the aqueous solution S is injected for 1000 $Nm^3$ of gases produced by the combustion in the boiler when the fuels are not waste.

In practice, the injection of the aqueous solution S is done through walls of the boiler, in particular through at least one side wall of the combustion chamber of the boiler. Thus, for a "small" size of the boiler, for example when the boiler is designed to handle less than 12 tons of waste per hour or to emit less than 60,000 $Nm^3$ per hour at its outlet, the solution is injected through a single side wall of the boiler; whereas for a "larger" size, for example when the boiler is provided to handle more than 12 tons of waste per hour or to emit more than 60,000 $Nm^3$ per hour at its outlet, the solution is injected through two side walls opposite one another.

The injection of the aqueous solution S, and consequently the concentrated solution if the solution S is obtained by dilution of this concentrated solution, can be continuous or sequential during the operation of the boiler. Thus, the process according to the invention can be carried out continuously or sequentially during the operation of the boiler. In the case of a sequential injection, it will be possible to carry out the process according to the invention for 1 to 5 cumulative hours per day with or without continuous maintenance of the water injection, preferably for 2 to 3 hours per day. This sequential injection will result in creating a stratification in the deposit, which will facilitate the cleaning operations.

The process of the present invention may be implemented during the operation of the boiler, but also during the startup phase of the boiler. This advantageously makes it possible to reduce the sticky nature of the first ash and allows an action comparable to a "vaccination" of the surface of the exchangers.

Existing techniques for cleaning boilers can be implemented in addition to the injection of the aqueous solution S. Thus, it is possible to implement additional cleaning techniques chosen from among:

micro-explosion; and/or steam injection; and/or striking.

The sequential injection of the aqueous solution S may be scheduled during cleaning phases done using the existing techniques and 30 minutes to 1 hour after stopping these cleaning phases in order to vaccinate surfaces that could have been exposed during these cleaning phases.

The process of the present invention, in addition to ensuring cleaning of the boiler, and in particular the surface of its exchangers, also makes it possible to limit the corrosion speed by the molten salts by increasing their melting temperature and limiting CO and NOx formation owing to the injection of water and the cooling of the gases resulting from the vaporization of the latter.

In order to implement the cleaning process outlined thus far, the cleaning device equipping the boiler comprises:

a source of the aqueous solution S as described above, a system for injecting this aqueous solution S inside the combustion chamber C of the boiler, a supply circuit for this injection system, which makes it possible both to transport the solution from the source to the injection system and to cool the injection system.

The source of aqueous solution S of the cleaning device may simply consist of a vat in which the ready-to-use aqueous solution S is stored. Alternatively, according to one preferred embodiment that is shown in FIG. 1, the source simultaneously comprises:

a vat 1 in which a solution concentrated in dissolved magnesium chloride and/or sulfate and/or dissolved calcium chloride is stored, as mentioned above, a metering pump 2 that makes it possible to meter the concentrated solution contained in the vat 1 and that brings this concentrated solution from the vat 1 to the supply circuit, referenced 5 in FIG. 1, of the cleaning device, a vat 3 in which the water is stored intended to allow the dilution of the concentrated solution contained in the vat 1 to form the aqueous solution S, and a metering pump 4 that makes it possible to meter the water in the vat 3 and to bring this water from the vat 3 to the supply circuit 5, where it mixes with the concentrated solution brought in by the metering pump 2 to form the aqueous solution S.

In practice, the water contained in the vat 3 advantageously corresponds to recycled water, for example coming from the industrial facility where the boiler is integrated: the liquid waste at the facility is thus limited, since at least some of it is reused within the facility, by the cleaning device.

Preferably, the metering pumps 2 and 4 are of the displacement or centrifugal pump type.

For the injection system, which is referenced 6 in the example shown in FIG. 1, several embodiments may be considered, as outlined below. In all cases, the injection system 6 is supplied by the supply circuit 5: more specifically, the injection system 6 is supplied on the one hand by a liquid transport line 5*a* of the supply circuit 5, which transports the aqueous solution S from the source of the cleaning device to the injection system 6, and on the other hand by a cooling line 5*c* of the supply circuit 5, which cools the injection system 6 by sending it a cooling fluid, in particular air. The cooling line 5*c* is preferably supplied by a blocking air fan 8.

According to considerations echoing explanations provided above, the injection system 6 is preferably situated in the aforementioned lower part of the furnace of the combustion chamber C, where the primary combustion develops: this arrangement guarantees a substantial residence time in the combustion chamber C for the aqueous solution S injected by the injection system 6. In practice, the injection system 6 is preferably arranged before the secondary air injection zones B, as shown in FIG. 1.

According to one preferred arrangement, the injection system 6 includes several injection elements distributed in different locations of the boiler, in particular on the side walls of the boiler. The injection system 6 thus for example includes between 1 and 6 injection elements, based on the size of the boiler.

Furthermore, the element(s) of the injection system 6, which are all identical or different, are preferably each chosen from among:

either a compressed air spraying device: in this case, the supply circuit 5 comprises, in addition to its liquid transport line 5*a* and its cooling line 5*c*, an air supply line 5*b*, which supplies the device for spraying compressed air to assist the spraying, this air supply line 5*b* being connected to a compressed air supply 7*a*, optionally connected to a network 7*b* of the facility; the liquid pressure of the liquid transport line 5*a* is preferably comprised between 1 and 6 bars, and the air pressure of the air supply line 5*b* is preferably comprised between 1 and 6 bars;

or a high-pressure pump (without the assistance of compressed air): in this case, the pressure of the liquid transport line 5*a* is preferably comprised between 10 and 50 bars.

One preferred embodiment consists of providing that the injection system 6 includes at least two compressed air spraying devices, which each include an injection nozzle 6*a* and which are in particular distributed around side walls of the combustion chamber C.

Advantageously, the device according to the invention may also comprise a temperature measuring device P in the primary combustion zone. The presence of this device makes it possible, as mentioned above, to allow the injection of water into the vat 3 to be made subject to the temperature of the primary combustion zone of the combustion chamber C. The temperature measuring device P may be an infrared pyrometer and/or a thermocouple, preferably an infrared pyrometer.

The invention claimed is:

1. A process for cleaning a boiler, comprising, while fumes are emitted in a combustion chamber of the boiler and circulate up to exchangers of the boiler, injecting an aqueous solution of dissolved magnesium chloride and/or dissolved magnesium sulfate and/or dissolved calcium chloride into a primary combustion zone of the combustion chamber, disposed upstream of secondary air inlets, in the form of droplets which, by vaporization of the water of the aqueous solution, then thermal decomposition, are transformed in the primary combustion zone of the combustion chamber into magnesium and/or calcium oxide particles reacting in the primary combustion zone of the combustion chamber by mixing with molten salts and/or molten oxides, present in the fumes, to crystallize these molten salts and/or to vitrify these molten oxides before these molten salts and/or these molten oxides come into contact with the exchangers.

2. The process for cleaning a boiler according to claim 1, wherein the primary combustion zone of the combustion chamber has a temperature of at least 1100° C.

3. The process for cleaning a boiler according to claim 1, wherein the aqueous solution is injected into the combustion chamber between a grate of this combustion chamber and secondary air injections.

4. The process for cleaning a boiler according to claim 1, wherein the aqueous solution is injected into the primary combustion zone of the combustion chamber such that the magnesium and/or calcium oxide particles that the aqueous solution produces therein have a mean diameter smaller than 10 μm.

5. The process for cleaning a boiler according to claim 1, wherein the aqueous solution is injected into the primary combustion zone of the combustion chamber such that the magnesium and/or calcium oxide particles that the aqueous solution produces therein have a mean diameter comprised between 0.1 and 5 μm.

6. The process for cleaning a boiler according to claim 1, wherein the aqueous solution is a solution of:

$MgSO_4$; or $MgCl_2$; or $MgSO_4$ and $MgCl_2$; or $CaCl_2$; or $MgCl_2$ and $CaCl_2$.

7. The process for cleaning a boiler according to claim 1, wherein the aqueous solution comprises from 6 to 600 g/l of dissolved anhydrous magnesium chloride, dissolved anhydrous magnesium sulfate and dissolved anhydrous calcium chloride.

8. The process for cleaning a boiler according to claim 1, wherein:

between 10 l and 100 l of the aqueous solution is injected into the primary combustion zone of the combustion chamber per ton of waste incinerated in the boiler, or between 2 l and 20 l of the aqueous solution is injected into the primary combustion zone of the combustion chamber for 1000 $Nm^3$ of gases produced by the combustion in the boiler when the fuels of the boiler are not waste.

9. The process for cleaning a boiler according to claim 1, wherein the aqueous solution is injected into the primary combustion zone of the combustion chamber using a compressed air spraying device or a high-pressure pump.

10. The process for cleaning a boiler according to claim 1, wherein at least one additional cleaning technique is implemented, chosen from among:

micro-explosion;

steam injection; and striking.

11. A boiler, equipped with a cleaning device for cleaning said boiler, the cleaning device being designed to implement a process in which, while fumes are emitted in a combustion chamber of the boiler and circulate up to exchangers of the boiler, an aqueous solution of dissolved magnesium chloride and/or dissolved magnesium sulfate and/or dissolved calcium chloride is injected into a primary combustion zone of the combustion chamber in the form of droplets which, by vaporization of the water of the aqueous solution, then thermal decomposition, are transformed in the primary combustion zone of the combustion chamber into magnesium and/or calcium oxide particles reacting in the combustion chamber by mixing with molten salts and/or molten oxides, present in the fumes, to crystallize these molten salts and/or to vitrify these molten oxides before these molten salts and/or these molten oxides come into contact with the exchangers, the cleaning device comprising:

a source of an aqueous solution of dissolved magnesium chloride and/or sulfate and/or dissolved calcium chloride, an injection system for injecting the aqueous solution inside the primary combustion zone of the combustion chamber of the boiler, at a location upstream of secondary air inlets, the injection system including at least one injection element that is in the primary combustion zone of the combustion chamber, on a side wall of the boiler, and a supply circuit for supplying the injection system, the supply circuit being designed both to transport the aqueous solution from the source to the injection system and to cool the injection system.

12. The boiler according to claim 11, wherein the supply circuit comprises a cooling line to cool the injection system, the cooling line being designed to send a cooling fluid to the injection system.

13. The boiler according to claim 11, wherein the source comprises:

a first vat in which a solution concentrated in magnesium chloride and/or sulfate and/or calcium chloride is stored, a first metering pump suitable for metering the concentrated solution of the first vat and bringing this concentrated solution from the first vat to the supply circuit, a second vat in which water is stored, and a second metering pump suitable for metering the water of the second vat and bringing this water from the second vat to the supply circuit, where this water mixes with the concentrated solution brought in by the first metering pump to form the aqueous solution.

14. The boiler according to claim 11, wherein the injection system comprises at least one compressed air spraying device, and wherein the supply circuit comprises:

a liquid transport line, which transports the aqueous solution from the source to the at least one compressed air spraying device and an air supply line, which supplies compressed air to the at least one compressed spraying device to assist with spraying.

15. The boiler according to claim 11, wherein the injection system comprises at least one compressed air spraying device, and wherein the supply circuit comprises:

a liquid transport line which transports the aqueous solution from the source to the at least one compressed air spraying device and the liquid pressure of which is comprised between 1 and 6 bars, and an air supply line, which supplies compressed air to the at least one compressed spraying device to assist with spraying and the air pressure of which is comprised between 1 and 6 bars.

* * * * *